US008152430B2

(12) United States Patent
Lonardi et al.

(10) Patent No.: US 8,152,430 B2
(45) **Date of Patent: *Apr. 10, 2012**

(54) THREE HOPPER CHARGING INSTALLATION FOR A SHAFT FURNACE

(75) Inventors: Emile Lonardi, Bascharage (LU); Guy Thillen, Diekirch (LU); Jean Gidt, Hollenfels (LU); Patrick Hutmacher, Bettembourg (LU)

(73) Assignee: Paul Wurth S.A., Luxembourg (LU)

( * ) Notice: Subject to any disclaimer, the term of this patent is extended or adjusted under 35 U.S.C. 154(b) by 506 days.

This patent is subject to a terminal disclaimer.

(21) Appl. No.: 12/161,588

(22) PCT Filed: Dec. 29, 2006

(86) PCT No.: PCT/EP2006/070268

§ 371 (c)(1),
(2), (4) Date: Jul. 21, 2008

(87) PCT Pub. No.: WO2007/082633

PCT Pub. Date: Jul. 26, 2007

(65) Prior Publication Data

US 2009/0087284 A1 Apr. 2, 2009

(30) Foreign Application Priority Data

Jan. 20, 2006 (EP) ..... 06100681

(51) Int. Cl.
*F27D 3/00* (2006.01)

(52) U.S. Cl. ..... 414/206; 414/199; 414/216; 414/301; 266/184; 266/197

(58) Field of Classification Search ..... 414/162, 414/199, 200, 216, 206, 301; 266/184, 197
See application file for complete search history.

(56) References Cited

U.S. PATENT DOCUMENTS 3,693,812 A 9/1972 Mahr et al.
(Continued)

FOREIGN PATENT DOCUMENTS

JP 61221016 7/1986
(Continued)

OTHER PUBLICATIONS

International Search Report PCT/EP2006/070268 Dated Apr. 11, 2007.

(Continued)

*Primary Examiner* — Scott Lowe
(74) *Attorney, Agent, or Firm* — Cantor Colburn LLP

(57) ABSTRACT

A three hopper charging installation for a shaft furnace includes a rotary distribution device for distributing bulk material in the furnace by rotating a distribution member about the furnace central axis and a first, a second and a third hopper arranged in parallel above the rotary distribution device and offset from the central axis. A sealing valve housing is arranged between the hoppers and the distribution device. It has a top part with a first, a second and a third inlet respectively communicating with the first, the second and the third hopper. A first, a second and a third sealing valve are provided in the top part. Each sealing valve includes a flap which is pivotable between a closed sealing position and an open parking position. The sealing valve housing also has a funnel shaped bottom part with an outlet communicating with the distribution device. According to the invention, the top part of the sealing valve housing has a tripartite stellate configuration in horizontal section with a central portion, in which the inlets are arranged adjacently in triangular relationship about the central axis, and with a first, a second and a third extension portion, each sealing valve being adapted such that its flap opens outwardly with respect to the central axis by pivoting into a parking position located in the first, second or third extension portion respectively.

26 Claims, 9 Drawing Sheets

U.S. PATENT DOCUMENTS

| | | | | |
|---|---|---|---|---|
| 3,929,240 | A | 12/1975 | Legille et al. | |
| 4,042,130 | A | 8/1977 | Legille et al. | |
| 4,074,816 | A | 2/1978 | Legille | |
| 4,138,022 | A | 2/1979 | Mochizuki et al. | |
| 4,243,351 | A | 1/1981 | Legille et al. | |
| 4,599,028 | A | 7/1986 | Mahr et al. | |
| 4,728,240 | A | 3/1988 | Mahr et al. | |
| 5,385,437 | A | 1/1995 | Lonardi et al. | |
| 6,580,744 | B1 * | 6/2003 | Irnich | 373/79 |
| 2009/0087284 | A1 | 4/2009 | Lonardi et al. | |

FOREIGN PATENT DOCUMENTS

| | | | |
|---|---|---|---|
| JP | 62-218506 | | 9/1987 |
| JP | 2-182811 | | 7/1990 |
| JP | 2182811 | * | 7/1990 |
| JP | 4-308012 | | 10/1992 |
| JP | 6-145731 | | 5/1994 |
| JP | 6-271915 | | 9/1994 |
| JP | 09249905 | | 9/1997 |
| JP | 09296206 | | 11/1997 |
| JP | 9296206 | * | 11/1997 |
| JP | 2002121610 | | 4/2002 |
| JP | 2004010980 | | 1/2004 |
| JP | 2002256314 | | 7/2008 |

OTHER PUBLICATIONS

International Search Report PCT/EP2006/070214 dated May 18, 2007.

* cited by examiner

THREE HOPPER CHARGING INSTALLATION FOR A SHAFT FURNACE

TECHNICAL FIELD OF THE INVENTION

The present invention generally relates to the field of charging installations for shaft furnaces such as blast furnaces. More particularly, the present invention relates to a three hopper charging installation for a shaft furnace.

BRIEF DISCUSSION OF RELATED ART

BELL LESS TOP charging installations have found widespread use in blast furnaces around the world. They commonly comprise a rotary distribution device equipped with a rotatable distribution member, e.g. a distribution chute which is rotatable about the vertical central axis of the furnace and pivotable about a horizontal axis perpendicular to the central axis. So called "parallel hopper top" installations comprise multiple hoppers arranged in parallel above the rotary distribution device for intermediate storage of bulk material to be fed to the distribution device. These installations allow quasi-continuous charging of bulk material, since one hopper can be (re)filled whilst another previously filled hopper is being emptied to feed the distribution device.

In order to connect the hoppers to the rotary distribution device, such "parallel hopper top" installations commonly have a valve housing arranged between the parallel hoppers and the distribution device. Such a valve housing has a top part with a respective inlet for each hopper. For each hopper a respective sealing valve is provided for isolating each hopper respectively from the inner atmosphere of the shaft furnace by means of a flap which is pivotable between a closed sealing position and an open parking position. The valve housing normally has a funnel shaped bottom part with an outlet communicating with the distribution device.

Depending on the complexity of the charging program, a BELL LESS TOP charging installation with three parallel hoppers is required to achieve the targeted production of pig iron per day. In order to minimize idle time when changing the feeding hopper and in order to allow simultaneous feeding from two hoppers, it is required that the sealing valves can be open simultaneously. In some existing three hopper charging installations this is not possible because a given opened sealing valve impedes opening of a further valve. In other existing three hopper charging installations, which allow simultaneous opening of the sealing valves, the sealing valves and accordingly the inlets in the valve housing are widely spaced apart so as to allow simultaneous opening of two sealing valves. In consequence, such three hopper charging installations in general, and their valve housings in particular, take up a lot of space. Furthermore, adequate centering of the flow of charge material onto the distribution member is difficult to achieve in these installations.

BRIEF SUMMARY OF THE INVENTION

The invention provides a three hopper charging installation with a valve housing for the sealing valves which provides an improved connection between the parallel hoppers and the distribution device.

The invention proposes a three hopper charging installation for a shaft furnace, which comprises a rotary distribution device for distributing bulk material in the shaft furnace by rotating a distribution member about a central axis of the shaft furnace and a first, a second and a third hopper arranged in parallel above the rotary distribution device and offset from the central axis, for storing bulk material to be fed to the distribution device. A sealing valve housing is arranged between the hoppers and the distribution device and has a top part with a first, a second and a third inlet respectively communicating with the first, the second and the third hopper. A first, a second and a third sealing valve for isolating the first, the second and the third hopper respectively from the inner atmosphere of the shaft furnace are provided in the top part. Each sealing valve comprises a flap which is pivotable between a closed sealing position and an open parking position. The sealing valve housing also has a funnel shaped bottom part with an outlet communicating with the distribution device. According to an important aspect of the invention, the top part of the sealing valve housing has a tripartite stellate configuration in horizontal section with a central portion, in which the inlets are arranged adjacently in triangular relationship about the central axis, and with a first, a second and a third extension portion, each sealing valve being adapted such that its flap opens outwardly with respect to the central axis by pivoting into a parking position located in the first, second or third extension portion respectively.

This configuration allows simultaneous opening of two sealing valves by means of a compact sealing valve housing, i.e. without requiring excessive constructional space. Furthermore, this configuration enables improving the flow path of charge material (between the hoppers and the distribution device) and facilitating maintenance procedures.

In a preferred configuration, the centre lines of the inlets are equidistant and form an equilateral triangle in horizontal section. Advantageously, the inlets have identical circular cross-section and the distance between the centre line of each inlet and the central axis is in the range between 1.15 and 2.5 times the radius of the circular cross-section. Preferably, each extension portion of the sealing valve housing extends in the direction of one of the median lines of the equilateral triangle respectively. Advantageously, each extension portion has a height exceeding the diameter of the flap and each sealing valve is preferably configured with a pivoting angle of its flap of at least 90°.

In a further preferred configuration, each hopper has a lower funnel part ending in an outlet portion and each hopper has a material gate valve with a shutter member associated to its outlet portion for varying a valve opening area at the associated outlet portion. In this configuration, each funnel part is configured asymmetrically with its outlet portion being eccentric and arranged proximate to the central axis, each outlet portion is oriented vertically above a respective inlet of the sealing valve housing so as to produce a substantially vertical outflow of bulk material into the sealing valve housing and each material gate valve is configured with its shutter member opening in a direction pointing away from the central axis such that any partial valve opening area is located on the side of the associated outlet portion proximate to the central axis. In this configuration it is advantageous if each funnel part is configured according to the surface of a frustum of an oblique circular cone. It will be appreciated that the design of the sealing valve housing allows to take full benefit of this preferred configuration of the hoppers.

In yet a further preferred configuration, the charging installation further comprises a first, a second and a third independent material gate housing detachably connected upstream of the first, the second and the third inlet respectively.

BRIEF DESCRIPTION OF THE DRAWINGS

Further details and advantages of the present invention will be apparent from the following detailed description of several not limiting embodiments with reference to the attached drawings, in which.

In these drawings, identical reference numerals will be used to identify identical or similar parts throughout.

DETAILED DESCRIPTION OF THE INVENTION

Figure 1:
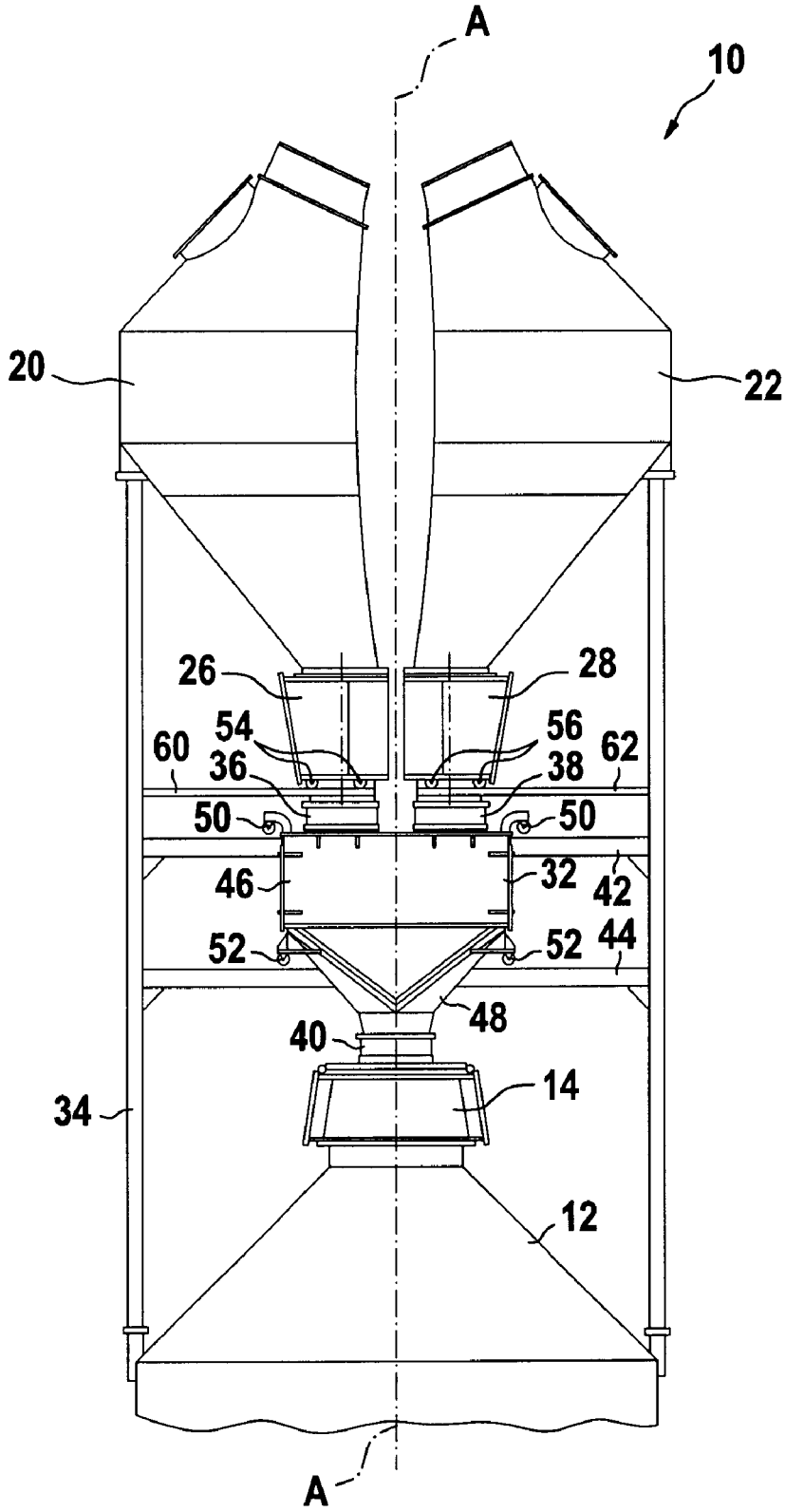
FIG. 1 is a side view of a two hopper charging installation for a shaft furnace.

Referring to FIGS. 1-4, a two hopper charging installation, generally identified by reference numeral 10, will be described in the following first part of the detailed description.

FIG. 1 shows the two hopper charging installation 10 on top of a blast furnace 12 of which only the throat is partially shown. The charging installation 10 comprises a rotary distribution device 14 arranged as top closure of the throat of the blast furnace 12. The rotary distribution device 14 per se is of a type known from existing BELL LESS TOP installations. For distributing bulk material inside the blast furnace 12, the distribution device 14 comprises a chute (not shown) serving as distribution member. The chute is arranged inside the throat so as to be rotatable about the vertical central axis A of the blast furnace 12 and pivotable about a horizontal axis perpendicular to axis A.

As seen in FIG. 1, the charging installation 10 comprises a first hopper 20 and a second hopper 22 which are arranged in parallel above the distribution device 14 and offset from the central axis A. In a manner known per se, the hoppers 20, 22 serve as storage bins for bulk material to be distributed by the distribution device 14 and as pressure locks avoiding the loss of pressure in the blast furnace by means of alternatively open and closed upper and lower sealing valves. Each hopper 20, 22, has a respective material gate housing 26, 28 at its lower end. As will be appreciated, a separate and independent material gate housing 26, 28 is provided for each hopper 20, 22. A common sealing valve housing 32 is arranged in between the material gate housings 26, 28 and the distribution device 14 and connects the hoppers 20, 22, via the material gate housings 26, 28 to the distribution device 14. FIG. 1 further shows a supporting structure 34 supporting the hoppers 20, 22 on the furnace shell of the blast furnace 12.

Figure 4:
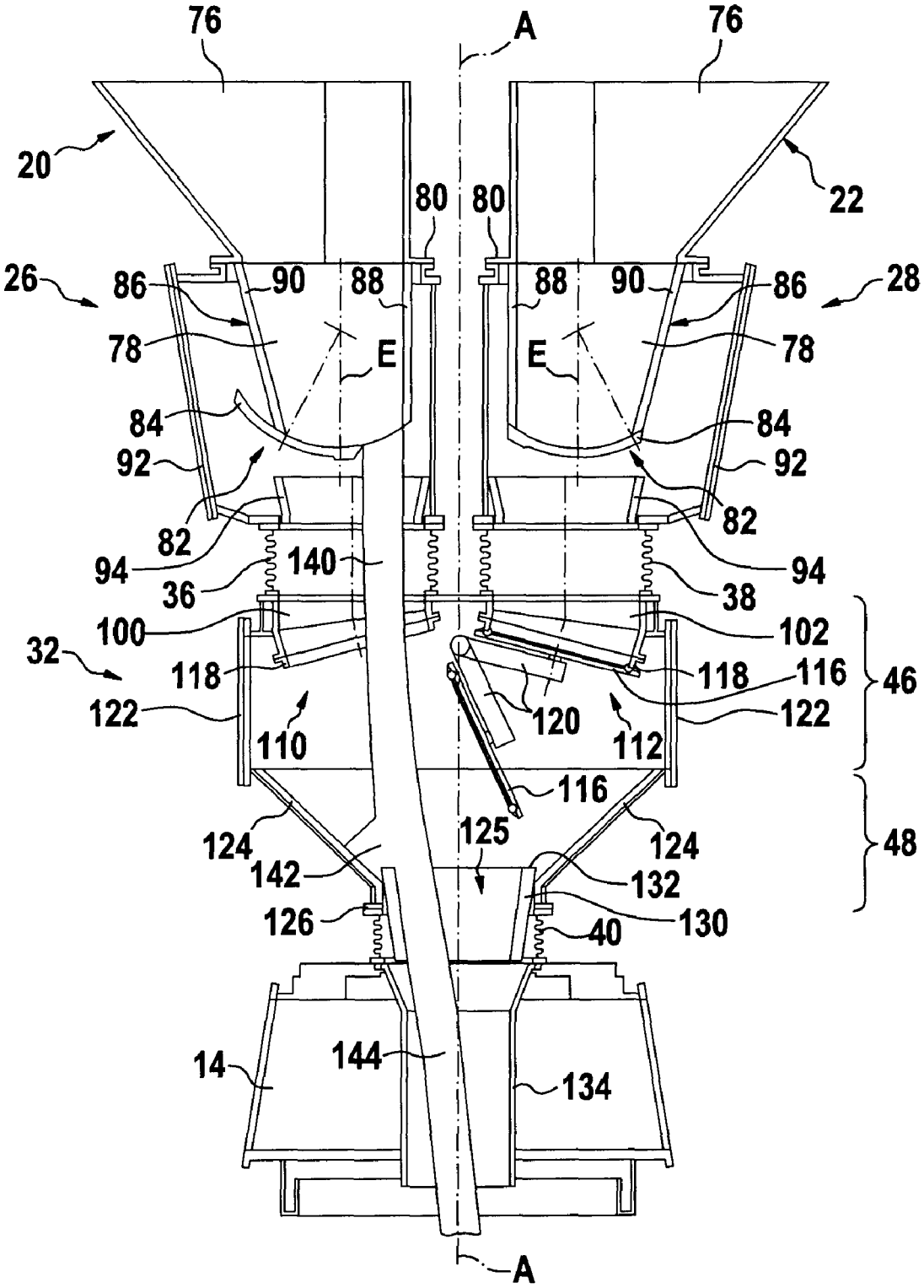
FIG. 4 is a vertical cross-sectional view schematically showing a flow of charge material through a material gate housing and a sealing valve housing in a two hoppers charging installation.

Two upper compensators 36, 38 are provided for sealingly connecting inlets of the sealing valve housing 32 to each material gate housing 26, 28 respectively. A lower compensator 40 is provided for sealingly connecting an outlet of the sealing valve housing 32 to the distribution device 14. In general, the compensators 36, 38, 40 (bellows compensators are illustrated in FIG. 4) are designed to allow relative motion between the connected parts e.g. in order to buffer thermal dilatation, while insuring a gas-tight connection. More particularly, the upper compensators 36, 38 warrant that the weight of the hoppers 20, 22 (and material gate housings 26, 28) measured by weighing beams of a weighing system, which carry the hoppers 20,22 on the support structure 34, is not detrimentally influenced by the connection to the sealing valve housing 32. In the support structure 34 of FIG. 1, the sealing valve housing 32 is detachably attached, e.g. using bolts, to the support structure 34 by means of horizontal support beams 42, 44. By virtue of the support beams 42, 44 and the compensators 36, 38, 40, the weight of the sealing valve housing 32 is carried exclusively by the support structure 34 (i.e. no load is exerted by the weight of the sealing valve housing 32 on the hoppers 20, 22 or on the distribution device 14).

As seen in FIG. 1, the sealing valve housing 32 comprises a top part 46, having the shape of a rectangular casing, and a funnel shaped bottom part 48. The sealing valve housing 32 is configured with the top part 46 and the bottom part 48 releasably connected, e.g. using bolts, such that they can be separated. The top and bottom parts 46, 48 are respectively provided with a set of supporting rollers 50, 52 facilitating dismantling of the sealing valve housing 32 e.g. for maintenance purposes. After disconnecting the lower compensator 40 and the fixation to the support beams 44 and after separating the bottom part 48 from the top part 46, the bottom part 48 can be rolled out independently with the supporting rollers 52 on the support beams 44. Similarly, after disconnecting the upper compensators 36, 38 and the fixation to the support beams 42 and after separating the top part 46 from the bottom part 48, the top part 46 can be rolled out independently with the supporting rollers 50 carried by the support beams 42. As will be understood, the sealing valve housing 32 can also be rolled out entirely using the rollers 50, after disconnecting compensators 36, 38, 40 and the fixation to the support beams 42, 44. As further seen in FIG. 1, each material gate housing 26, 28 has respective supporting rollers 54, 56 for rolling out the material gate housing 26, 28 on respective support rails 60, 62 attached to the support structure 34. Accordingly, each material gate housing 26, 28 can be dismantled easily and independently after disconnection of the respective upper compensator 36, 38 and the respective fixation to the lower part of the hopper 20, 22.

Figure 2:
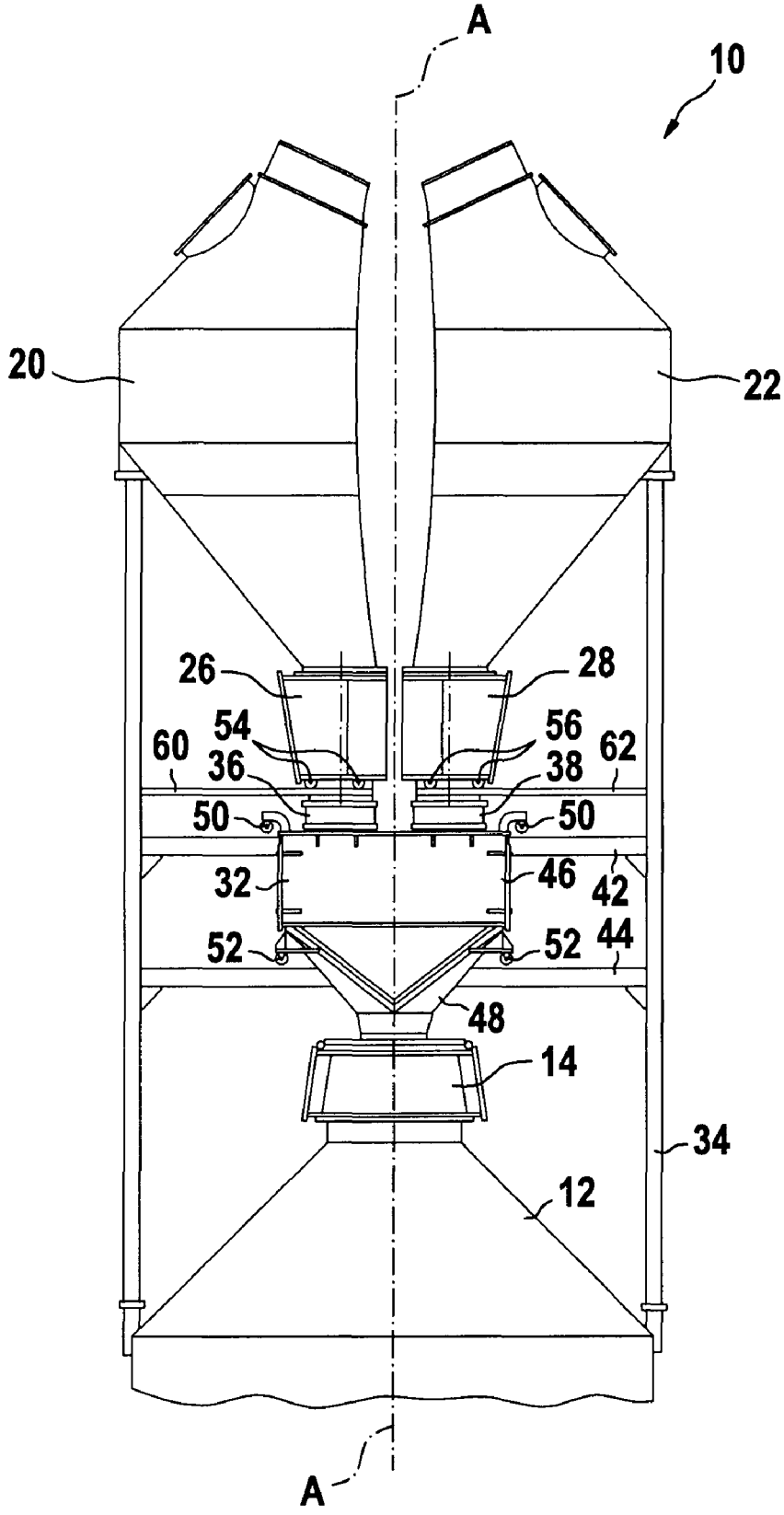
FIG. 2 is a side view of a two hopper charging installation for a shaft furnace, similar to FIG. 2, showing an alternative support structure.

FIG. 2 shows a charging installation 10 which is essentially identical to that shown in FIG. 1. The difference between the embodiments of FIG. 1 and FIG. 2 concerns in the construction of the support structure 34 and the manner in which the sealing valve housing 32 is supported. In FIG. 2, the sealing valve housing 32 is directly supported by the casing of the distribution device 14 on the throat of the blast furnace 12. Hence, there is no need for a compensator between the sealing valve housing 32 and the distribution device 14 and no need for a fixation of the sealing valve housing 32 to the support beams 42, 44 in the embodiment of FIG. 2. Accordingly, in this embodiment, the sealing valve housing 32 in FIG. 2 is not attached to the support beams 42, 44, which serve only as rails for the supporting rollers 50, 52 of the sealing valve housing 32. In order to transfer the load of the top and/or bottom part 46, 48 to the support beams 42, 44, the supporting rollers 50, 52 of FIG. 2 can be adapted to be lowered onto the support beams 42, 44, e.g. by means of an eccentric, or by lifting the top and/or bottom part 46, 48 onto auxiliary rails (not shown) to be inserted between rollers 50, 52 and the support beams 42, 44. Other aspects of the construction of the charging installation and the dismantling procedures for the sealing valve housing 32 and the material gate housings 26, 28 are analogous to those described with respect to FIG. 1.

Figure 3:
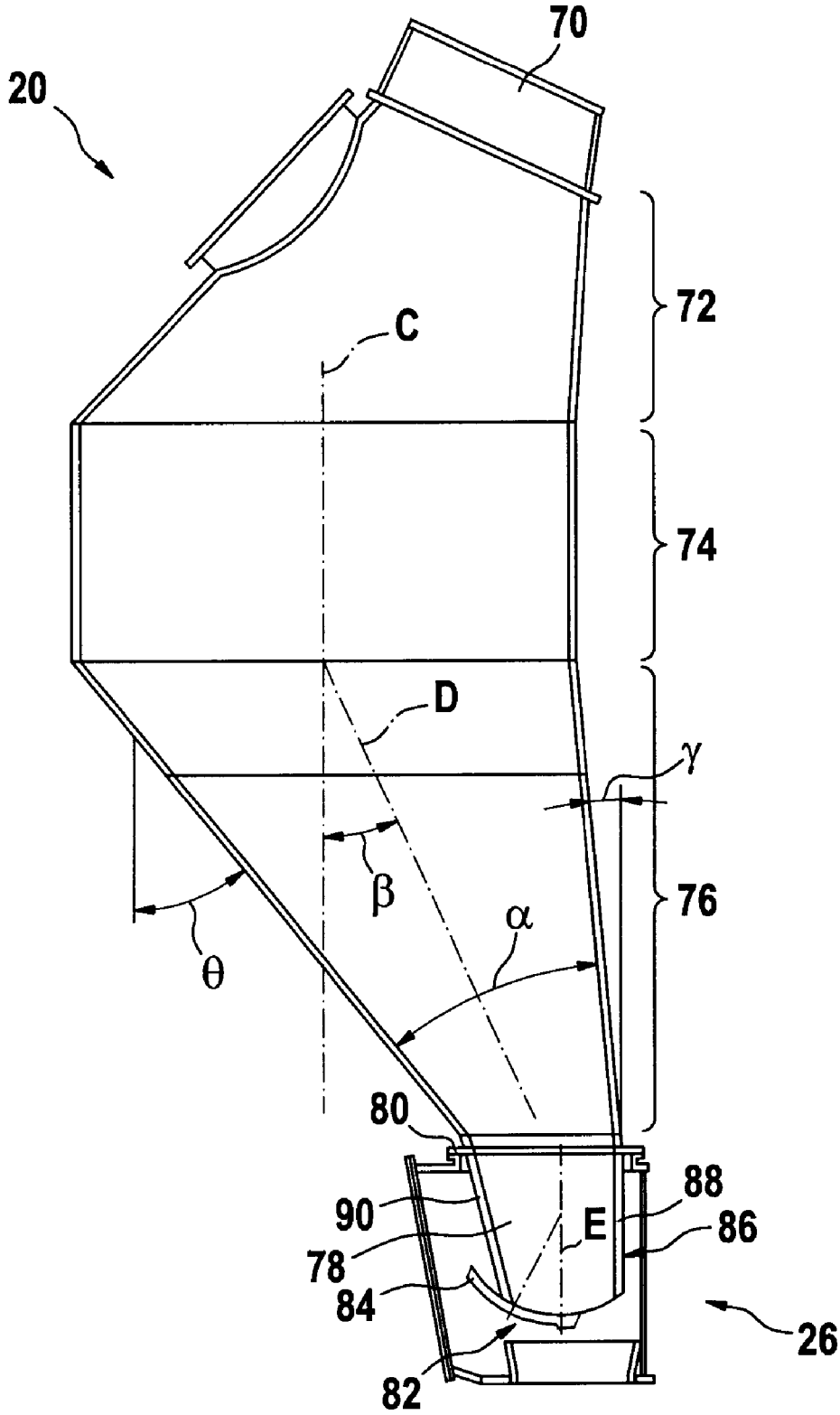
FIG. 3 is a vertical cross-sectional view of a hopper for use in a charging installation according to the invention.

FIG. 3 shows, in vertical cross-section, the configuration of a hopper 20 for use in a charging installation 10 according to the invention. The hopper 20 has an inlet portion 70 for admission of bulk material. The shell of the hopper 20 is made of a generally frusto-conical upper part 72, a substantially cylindrical centre part 74 and a lower funnel part 76. At its open lower end, the funnel part 76 leads into an outlet portion 78. As seen in FIG. 3, the configuration of the hopper 20 in general, and the funnel part 76 in particular, is asymmetrical with respect to the central axis C of the hopper 20 (i.e. the axis of the cylinder defining the centre part 74). More precisely, with respect to axis C, the outlet portion 78 is eccentric such that it can be arranged in close proximity of the central axis A of the blast furnace 12 as seen in FIGS. 1-2 and 4-9. It will be understood that to achieve this effect, the shape of the upper part 72 and the centre part 74 need not necessarily be as shown in FIG. 3, it is however required that the outlet portion 78 is arranged eccentrically.

As further seen in FIG. 3 (and FIG. 5) the lower funnel part 76 of the hopper 20 is configured according to the surface of a frustum of an oblique circular cone. The generatrix of this oblique cone coincides with the base circle of the cylindrical centre part 74. Since the vertical cross section of FIG. 3 passes through axis C and the (theoretic location of the) apex of the oblique cone, it shows the section line of the funnel part 76 which has maximum slope against the vertical (or minimum steepness). It has been found that the slope angle against the vertical in this section, indicated by $\theta$ in FIG. 3, of the funnel part should be at most 45°, and preferably in the range between 30° and 45°, in order to avoid a plug flow of bulk material during discharge. In the embodiment shown in FIG. 3 the slope angle $\theta$ is approximately 40°. Furthermore, the included angle of the oblique cone defining the shape of the funnel part 76, indicated by $\alpha$ in FIG. 3, is preferably less than 45° in order to promote a mass flow of bulk material during discharge. During mass flow, the bulk material is in motion at substantially every point inside the hopper whenever bulk material is discharged through the outlet portion 78. In the embodiment shown in FIG. 3, the oblique cone has an included angle $\alpha$ of approximately 35°. As regards the cone axis D, i.e. the axis passing through the centre of the circular generatrix and the apex of the oblique cone, it will be appreciated that the cone axis D is inclined against the vertical by an inclination angle $\beta$ which is sufficiently large to position the outlet portion 78 in close proximity of the central axis A. Consequently, the inclination angle $\beta$, is chosen in accordance with angles $\theta$ and $\alpha$, such that the section line of the funnel part 76 which is closest to the central axis is vertical or at counterslope, preferably by an angle $\gamma$ in the range between 0° and 10° against the vertical. In the embodiment of FIG. 3, the counterslope angle $\gamma$ is approximately 5° and in consequence, the inclination angle $\beta$ is set to approximately 22.5°.

FIG. 4 schematically shows the material gate housings 26, 28 in vertical cross section. Each material gate housing 26, 28 is attached, e.g. using bolts, with its upper inlet to a connection flange 80 at the lower end of the funnel part 76. Each material gate housing 26, 28 forms the support frame of a material gate valve 82 and an externally mounted associated actuator (shown in FIG. 5). The material gate valve 82 comprises a single one-piece cylindrically curved shutter member 84 and an octagonal chute member 86 with a lower outlet conformed to the curved shutter member 84. This type of material gate valve is described in more detail in U.S. Pat. No. 4,074,835. The octagonal chute member 86 forms the outlet portion 78 of the hopper 20 and is attached together with the material gate housing 26 or 28 to the connection flange 80. In a manner known per se, slewing motion of the shutter member 84 (by rotation about its axis of curvature) in front of the octagonal chute member 86 allows precise metering of bulk material discharged from the hopper 20 or 22 by varying the valve opening area of the material gate valve 82 at the outlet portion 78.

As will be appreciated however, the longitudinal axis E of the chute member 86 and hence the outlet portion 78 is oriented vertically. This enables a substantially vertical outflow of bulk material from each hopper 20, 22. It will also be appreciated that the side walls 88, 90 (only two side walls are shown) of the octagonal chute member 86 are arranged vertically or at small angles against the vertical, in order to warrant smooth, essentially edgeless transitions from the conically shaped lower part 76 into the outlet portion 78, i.e. the octagonal chute member 86, besides ensuring an essentially vertical outflow of bulk material. It may be noted that the outflow will not be exactly vertical but slightly directed towards the central axis A due to the eccentric configuration of each hopper 20, 22.

As seen in FIG. 4, each material gate valve 82 is configured with its shutter member 84 opening in a direction pointing away from the central axis A. In other words, the shutter member 84 slews away from the central axis A to increase the valve opening area and towards the central axis A to reduce the valve opening area. Accordingly, any partial valve opening area of the material gate valve 82 is located on the side of the outlet portion 78 which is proximate to the central axis A (as seen on the left-hand side of FIG. 4). By virtue of this configuration, i.e. the configuration of each hopper 20, 22, especially its funnel part 76 and its outlet portion 78, together with the configuration of the material gate valve 82, the flow of bulk material released from each hopper is nearly coaxial with respect to central axis A.

Each material gate housing 26, 28 comprises a comparatively large access door 92, which facilitates maintenance of the inner parts of the material gate valve 82. By virtue of a suitable overall height of the material gate housing 26, 28, the access doors 92 can be made sufficiently large to allow exchange of the octagonal chute member 86 and/or the shutter member 84 without the need for dismantling the material gate housing 26 or 28. Each material gate housing 26, 28 further comprises a lower outlet funnel 94 arranged in prolongation of the octagonal chute member 86.

FIG. 4 further shows the sealing valve housing 32 in vertical cross-section, with its rectangular box shaped top part 46 and its funnel shaped bottom part 48. The top part 46 of the sealing valve housing 32 has two inlets 100, 102, spaced apart by a relatively small distance. The inlets 100, 102 are connected to the outlet funnel 94 of the corresponding material gate housing 26, 28 via the upper compensator 36 or 38. FIG. 4 also shows the configuration of the (lower) sealing valves 110, 112, of the hoppers 20, 22. Each sealing valve 110, 112 is arranged in the top part 46 of the sealing valve housing 32 and has a flap 116 and a valve seat 118. The valve seat 118 is attached to a sleeve projecting downwardly into the housing 32. As seen in FIG. 4, each flap 116 is pivotable by means of an arm 120 about a horizontal axis into and out of sealing engagement with its valve seat 118. In a manner known per se, each sealing valve 110 or 112 is used to isolate the corresponding hopper 20, 22 when the latter is filled with bulk material through its inlet portion 70. The top part 46 of the sealing valve housing 32 has comparatively large lateral access doors 122 respectively associated to each sealing valve 110, 112 to facilitate maintenance.

The bottom part 48 of the sealing valve housing 32 is generally funnel shaped with slanting side walls 124 arranged to form a wedge which is symmetrical about the central axis A and leads into an outlet 125 centred on the central axis A. The side walls 124 are inwardly covered with a layer of wear resistant material. The bottom part 48 has a lower connection flange 126 by which it is connected to the casing of the distribution device 14 via the lower compensator 40. As seen in FIG. 4, a frusto-conical centering insert 130 is arranged concentric with axis A in outlet 125 of the sealing valve housing 32. The centering insert 130 is made of wear resistant material and arranged with its upper end face 132 protruding into the bottom part 48 to a level above the outlet 125. The centering insert 130 in the outlet 125 communicates with a feeder spout 134 of the distribution device 14.

Regarding the flow path of bulk material discharged from the hopper 20 or 22 it will be appreciated that the path is nearly centred on and coaxial to the central axis A. With respect to hopper 20, an exemplary flow path is shown in FIG. 4 for a certain valve opening area of the material gate valve 82. In a first flow segment 140, corresponding to the outflow discharged from the outlet portion 78, the flow is substantially vertical with a small horizontal velocity component directed towards the central axis A. By virtue of the protruding upper end face 132 of the centering insert 130, a small pile-up 142 of charge material is retained in the bottom part 48 of the sealing valve housing 32. Due to the pile-up 142, the flow is deviated into a second flow segment 144 which remains substantially vertical with an increased but still small velocity component directed towards the central axis A. As will be appreciated, the second flow segment 144 does not impact on the feeder spout 134. The shape and in particular the included angle of the frusto-conical centering insert 130 and its protrusion height into the sealing valve housing 32 are chosen so as to achieve an impact of the second flow segment 144 on the chute (not shown) of the distribution device 14, which is centred on the central axis A. Furthermore, the flow (140, 144) of bulk material has no substantial horizontal velocity component between the outlet portion 78 and its impact on the chute (not shown).

It remains to be noted that the charging installation shown in cross-section in FIG. 4 is essentially identical to that shown in FIG. 1, the only notable difference being that the section line of the funnel part 76 which is proximate to the central axis A is vertical in FIG. 4 instead of being at counterslope (as shown in FIG. 3).

Referring to FIGS. 5-9, a three hopper charging installation, generally identified by reference numeral 10', will be described in the following second part of the detailed description.

Figure 5:
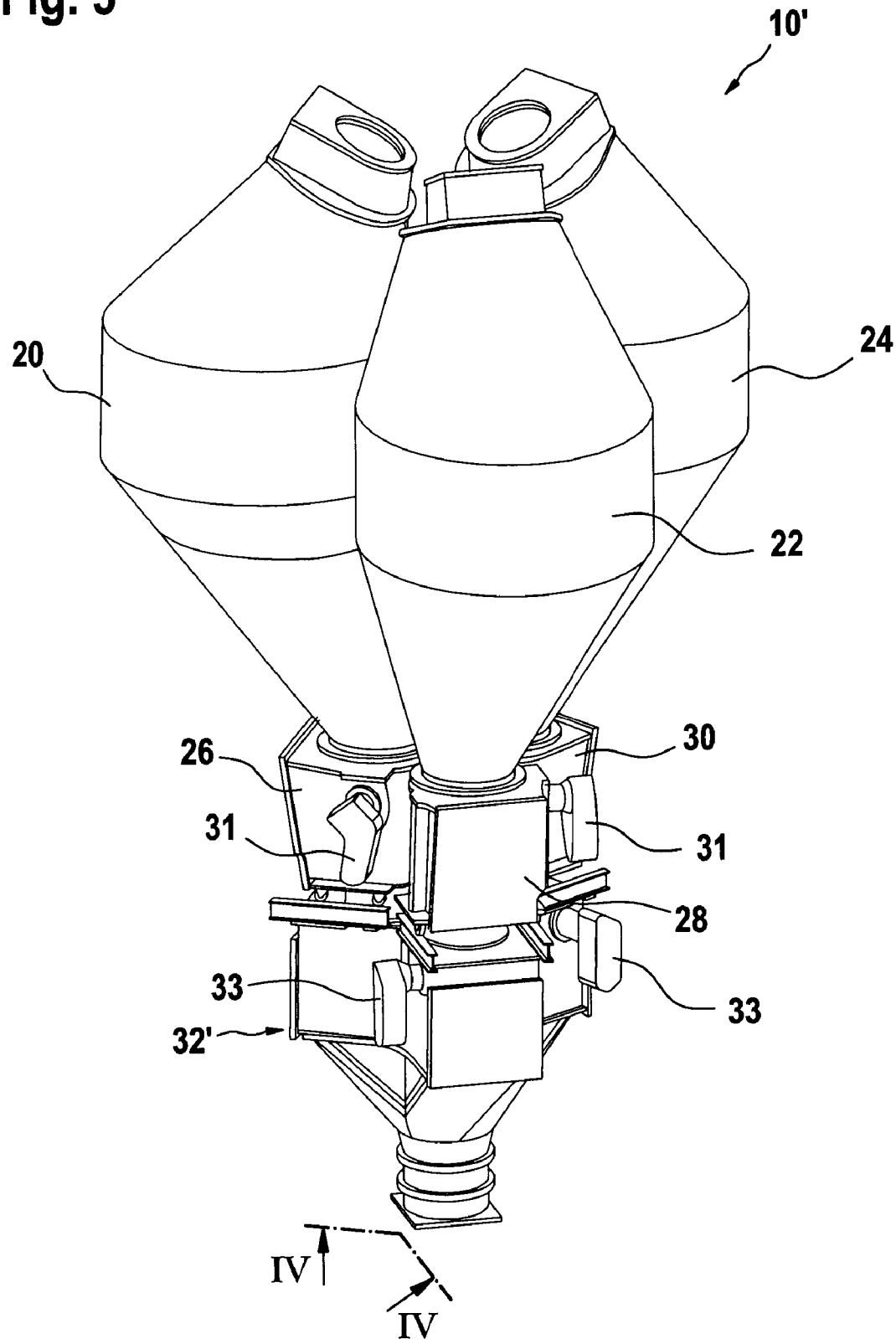
FIG. 5 is a perspective view of a three hopper charging installation for a shaft furnace.

FIG. 5 is a partial perspective view of the three hopper charging installation 10', which comprises a first hopper 20, a second hopper 22 and a third hopper 24. The hoppers 20, 22, 24 are arranged in rotational symmetry about the central axis A at angles of 120°. The configuration of the hoppers 20, 22, 24 corresponds to that described with respect to FIG. 3, i.e. the same hoppers can be used in two hopper and three hopper charging installations. Each hopper 20, 22, 24 has an associated separate and independent material gate housing 26, 28, 30. Alike the hoppers 20, 22, 24, the material gate housings 26, 28, 30 have modular design, such that the same material gate housings used in the two hopper charging installation 10 described above can be used in the three hopper charging installation 10'. The charging installation 10' further comprises a sealing valve housing 32' which is adapted for a three hopper design. FIG. 5 also shows material gate valve actuators 31 and sealing valve actuators 33 externally mounted to the material gate housings 26, 28, 30 or the sealing valve housing 32' respectively.

Figure 6:
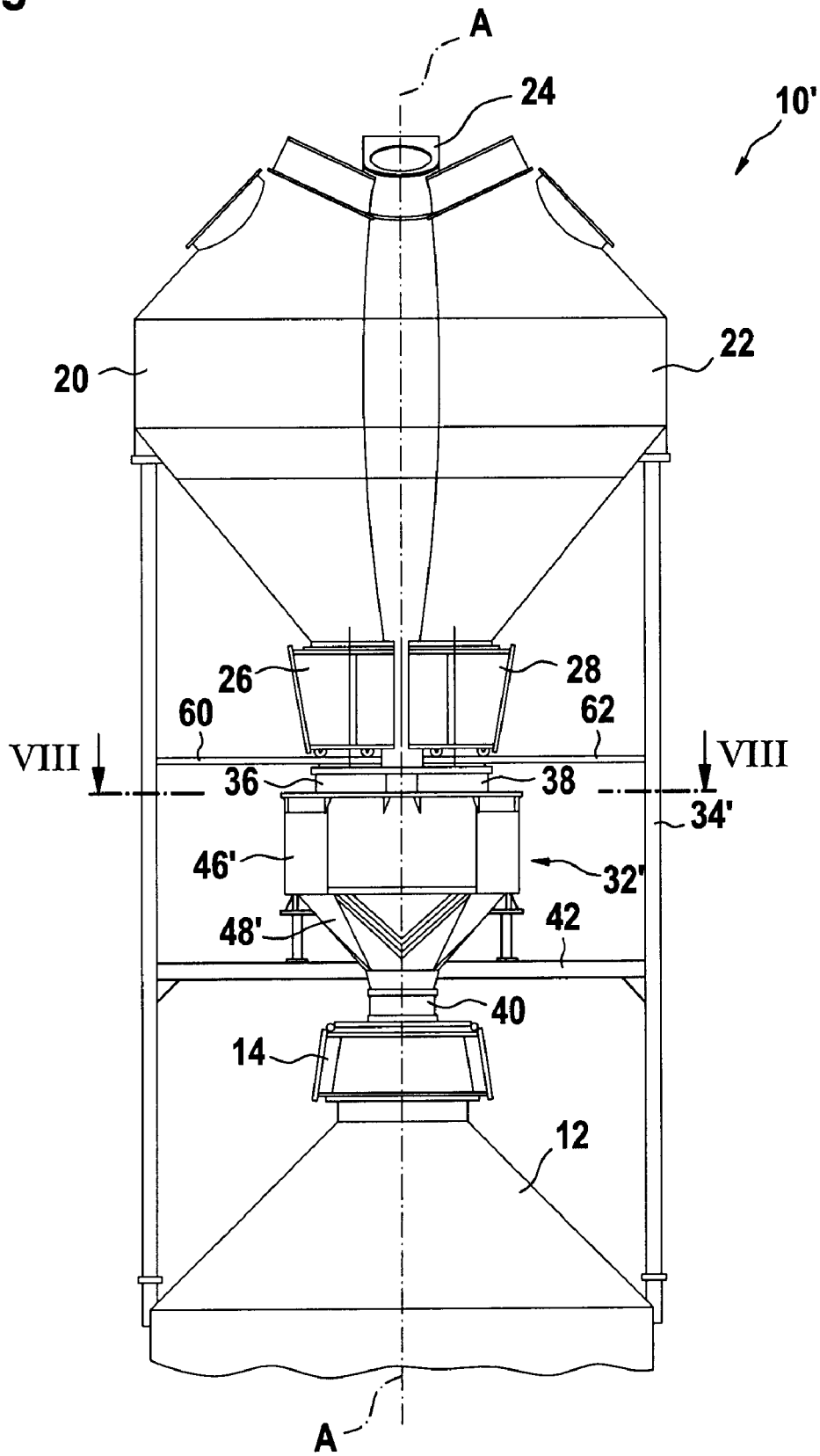
FIG. 6 is a side elevation of a three hopper charging installation for a shaft furnace according to line VI-VI in FIG. 5.

FIG. 6 shows the three hopper charging installation 10' of FIG. 5 with a first variant of a support structure 34'. In the support structure of FIG. 6, the sealing valve housing 32' is independently supported on support beams 42 and sealingly connected to the casing of the distribution device 14 by means of a lower compensator 40. Each of the three material gate housings 26, 28, 30 (the latter not being visible in FIG. 6) is sealingly connected to the sealing valve housing 32' by a respective upper compensator (only compensators 36, 38 are visible in FIG. 6). The material gate housings 26, 28, 30 are provided with supporting rollers and support rails (only 60 and 62 are visible) for facilitating dismantling. Although this would be possible, the sealing valve housing 32' is not provided with support rollers for dismantling in the embodiment of FIG. 6. It should be noted that, analogous to what is described for the two hopper sealing valve housing 32 in FIGS. 1-2, the sealing valve housing 32' also comprises a top part 46' and a bottom part 48' which can be separated.

Figure 7:
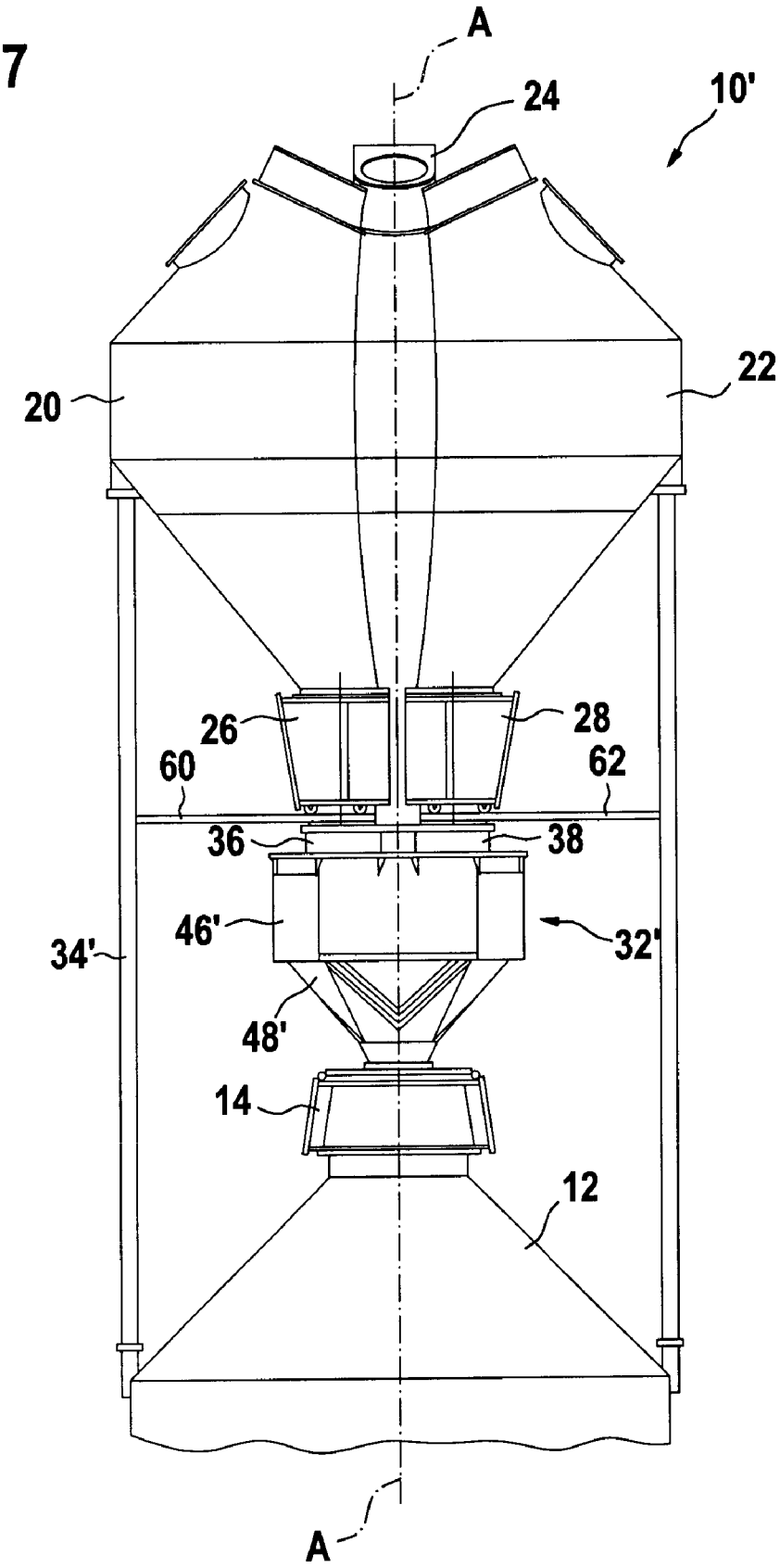
FIG. 7 is a side elevation of a three hopper charging installation for a shaft furnace, similar to FIG. 6, showing an alternative support structure.

FIG. 7 shows a three hopper charging installation 10' with a second variant of a support structure 34'. The three hopper charging installation 10' in FIG. 7 differs from that in FIG. 6 essentially in that the sealing valve housing 32' in FIG. 7 is directly supported by the casing of the distribution device 14 on the throat of the blast furnace 12. Consequently, there is no lower compensator between the sealing valve housing 32' and the casing of the distribution device 14 and no support beams for independently supporting the sealing valve housing 32'. As will be appreciated referring to FIGS. 5-7, the material gate housings 26, 28, 30 are respectively independent from each other and independent from the sealing valve housing 32'. Furthermore, no load is exerted onto the hoppers 20, 22, 24 by their connection to the sealing valve housing 32'.

Figure 8:
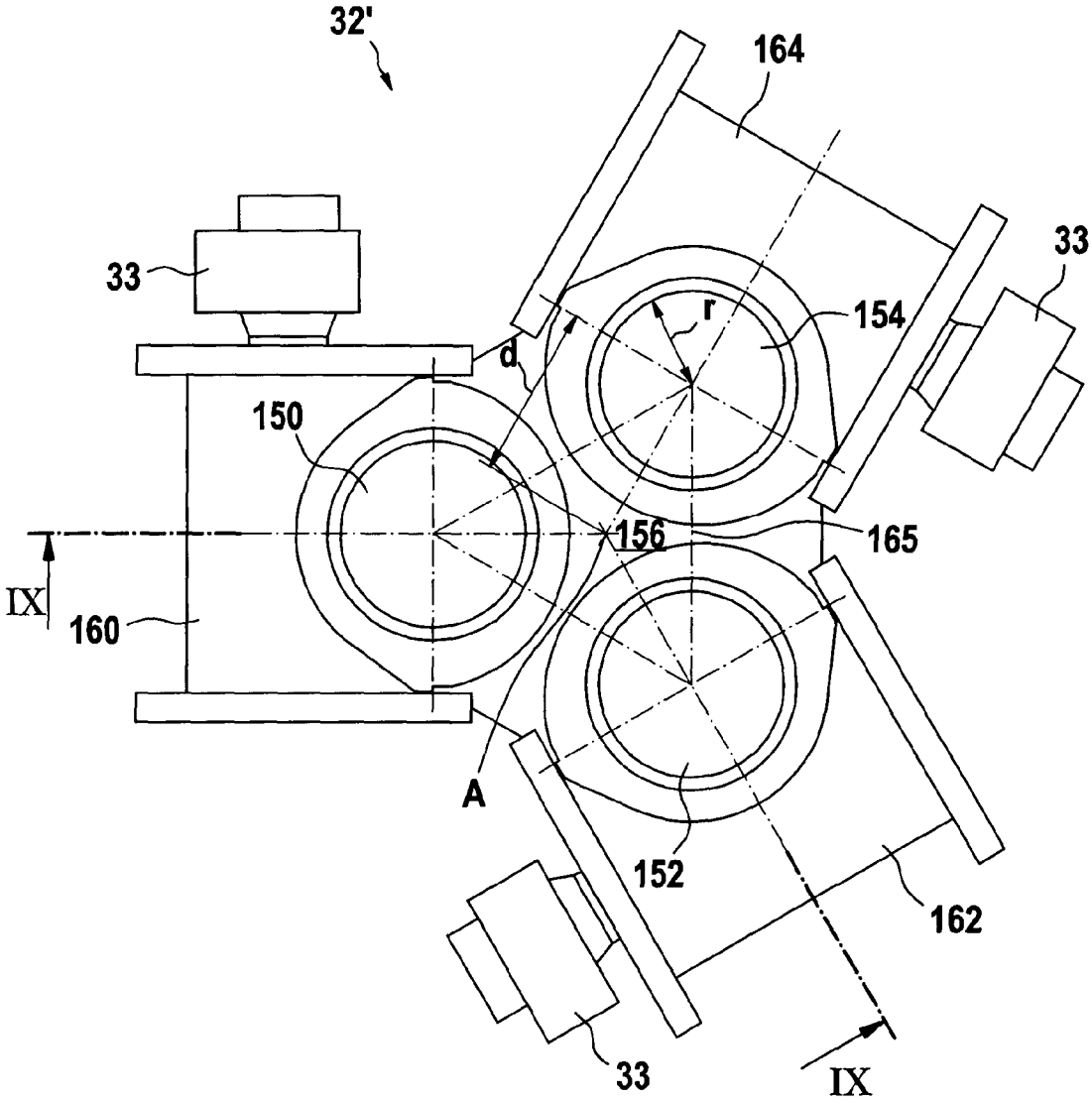
FIG. 8 is a top view along line VIII-VIII in FIG. 6 showing a sealing valve housing for a three hoppers charging installation.

FIG. 8 shows the sealing valve housing 32' and more precisely its top part 46' in top view. The sealing valve housing 32' comprises a first, a second and a third inlet 150, 152 and 154 for connection to each one of the hoppers 20, 22, 24. As seen in FIG. 8, the top part 46' has a tripartite stellate configuration in horizontal section with a central portion 156 and a first, a second and a third extension portion 160, 162, 164. The central portion 156 has a generally hexagonal base whereas the extension portions 160, 162, 164 have a generally rectangular base. The inlets 150, 152, 154 are arranged adjacently in triangular relationship about the central axis A in the central portion 156. In the embodiment of FIG. 8, the centre lines of the inlets 150, 152, 154 are equidistant so as to be located on the vertices of an equilateral triangle 165. The extension portions 160, 162, 164 extend radially and symmetrically outwards from the central portion 156 (at equal angles of 120°) i.e. in a direction according to the median lines of the triangle 165. The inlets 150, 152, 154 have identical circular cross-section of radius r. The distance d between the centre line of each inlet 150, 152, 154 and the central axis A is in the range between 1.15 and 2.5 times the radius r of the circular cross-section of the inlets 150, 152, 154. As will be appreciated, this tripartite stellate configuration with the inlets arranged in triangular relationship allows flow paths into the sealing valve housing 32' which are nearly centric i.e. coaxial to the central axis A.

Figure 9:
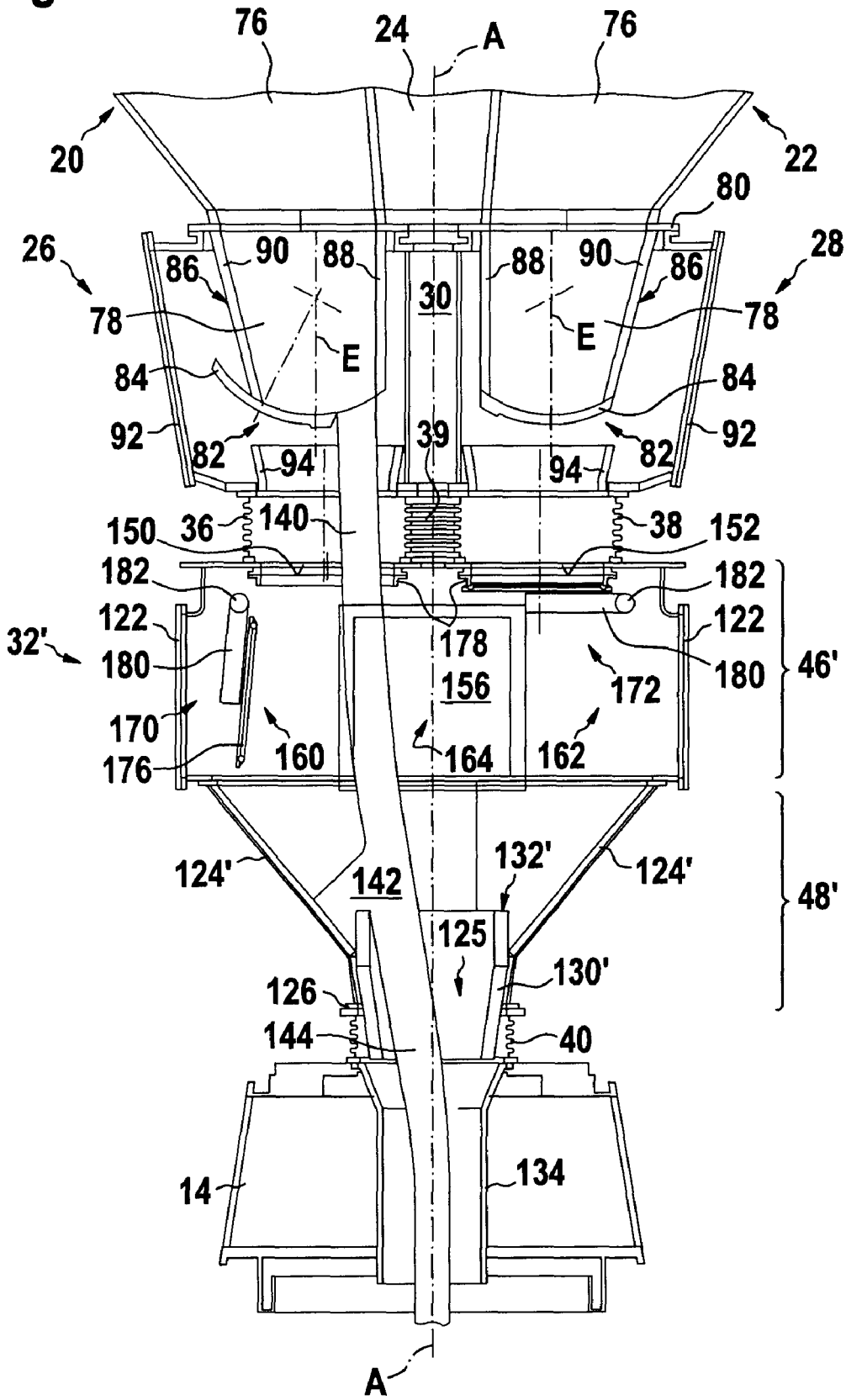
FIG. 9 is a vertical cross-sectional view, according to line IX-IX in FIG. 8, schematically showing a flow of charge material through a material gate housing and the sealing valve housing in a three hopper charging installation.

FIG. 9 shows, in a vertical cross section of the three hopper charging installation 10', among others the sealing valve housing 32'. FIG. 9 also shows the material gate housings 26, 28, 30 respectively connected to the inlets 150, 152 and 154 of the sealing valve housing 32' by means of compensators 36, 38, 39. The configuration of each sealing valve housing 26, 28, 30 corresponds to that described with respect to FIG. 4 and will not be described again. It may be noted that the configuration of each hopper 20, 22, 24 in the three hopper charging installation 10' is identical to the configuration of hopper 20 in FIG. 3.

The sealing valve housing 32' shown in FIG. 9 can be disassembled into a top part 46' and a funnel-shaped bottom part 48'. The top part 46' comprises the first, second and third sealing valve associated to the hoppers 20, 22, 24 respectively. Although only the sealing valves 170, 172 for the first and second hopper 20, 22 are shown in FIG. 9, it will be understood, that the third sealing valve for hopper 24 is arranged and configured analogously. Each sealing valve 170, 172 has a disc-shaped flap 176 and a corresponding annular seat 178. The seats 178 are arranged horizontally immediately underneath the respective inlets 150, 152, 154. Each flap 176 has an arm 180 mounted pivotable on a horizontal shaft 182 driven by the corresponding sealing valve actuator 33 (see FIG. 5) for pivoting the flap 176 between a closed sealing position on the seat 178 and an open parking position. As is apparent from FIGS. 8 and 9, each actuator 33 and each pivoting shaft is mounted, with respect to the central axis A, on the outward side of the respective inlet 150, 152, 154, i.e. in the extension portion 160, 162, 164. Hence it will be appreciated that each of the first, second and third sealing valves (only 170, 172 are shown in FIG. 9) is adapted such that its flap 176 opens outwardly with respect to the central axis A into a parking position located in the respective extension portion 160, 162, 164 of the top part 46'. To this effect, the height of the extension portions 160, 162, 164 exceeds the diameter of the flap 176 and preferably the pivoting radius of the flap 176. Furthermore, the pivoting angle of the flap 176 exceeds 90° such that, in parking position, it cannot cause an obstruction to the flow of charge material (flow segment 140). Although FIGS. 8 and 9 present a preferred embodiment in which each sealing valve 170 opens outwardly in the direction of a median line of the triangle 165, it is also possible to configure the sealing valves such that they open away from the central axis A in a direction perpendicular to the median lines using an appropriately adapted stellate configuration of the sealing valve housing.

As further seen in FIG. 9, the top part 46' comprises access doors 122 forming the front face of each extension portion 160, 162, 164. The bottom part 48' comprises inclined lateral side walls 124' arranged in accordance with the tripartite stellate base shape of the top part 46'. The centering insert 130' at the outlet 125 of the sealing valve housing 32' has a combined shape composed of a cylindrical upper section, with an upper end face 132' protruding into the bottom part 48', and a frusto-conical lower section communication with the feeder spout 134 of the distribution device 14. Regarding the flow path of bulk material discharged from the hopper 20, 22 or 24 reference is made to the description of FIG. 4.

Finally, some relevant advantages of the charging installations 10, 10' described above should be noted. Regarding both the two hopper and three hopper charging installations 10 and 10' it will be appreciated that:

- The shape of the hoppers 20, 22, 24 (eccentricity of their respective outlet portions 78) allows to position the material gate valves 82 closer to the central axis A. Furthermore, the material gate valves 82 are oriented vertically and open outwardly with respect to the central axis A. As a result, an outflow of bulk material 140 which is substantially vertical and nearly centred on the central axis A of the shaft furnace is obtained. Distribution symmetry of bulk material in the furnace (circularity of the burdening profile) is thereby improved and wear, especially of the feeder spout 134, is reduced. Furthermore, centre coke batches can be charged more accurately.
- No sharp deviations in the flow path of the bulk material are caused in the presented embodiments, this applies equally to the flow inside the hoppers 20, 22, 24 (and their outlet portions 78 i.e. octagonal chute members 86) and the flow downstream of the hoppers. Thereby segregation of bulk material is reduced. Furthermore wear, especially inside the hoppers 20, 22, 24 and their outlet portions, is reduced.
- The shape of the hoppers 20, 22, 24 and more particularly their funnel parts 78 together with the lack of sharp deviations promotes a mass flow of bulk material inside the hoppers 20, 22, 24. By virtue of a mass flow segregation is further reduced.
- The problem of dust accumulation underneath inclined octagonal chutes in known installations which falsifies weight measurements, is eliminated since the octagonal chute members 86 are oriented vertically. Hence corresponding cleaning maintenance is no longer required.
- Inclined chutes forming the hopper outlet portions in known installations are subject to significant wear and their replacement is difficult due to restrained access space. The octagonal chute members 86 being oriented vertically, wear is less pronounced. By virtue of the independent material gate housings 26, 28, 30, access and dismantling is simplified and the octagonal chute members 86 can be exchanged easily.
- The material gate housings 26, 28, 30 can be removed and replaced independently whereby potential downtime is reduced.
- Large access doors 92, 112, which are readily accessible, facilitate maintenance of the material gate valves 82 and the sealing valves 110, 112, 170, 172.
- In known charging installations, the material gate valves are often installed inside a common housing together with the sealing valves. To maintain the gate valve in position on the outlet, a flexible suspension of the material gate drive on this common housing is required, which adversely affects hopper weighing results. Using independent material gate housings 26, 28, 30 supporting the components of the material gate valves 82, which are fixedly attached to the respective hopper 20, 22, 24, the need for a flexible suspension and related influence on the weighing results is eliminated.
- Proven existing drive units (i.e. actuators 31 and 33) can be used for the material gate valves 82 and the sealing valves 110, 112, 170, 172.
- Exchange of the feeder spout 134 and the centering insert 130 is facilitated because the bottom part 48, 48' of the sealing valve housing 32, 32' can be dismantled and rolled out (described only for two hopper installation) separately.
- The charging installation 10, 10' is configured providing a comfortable access to each of the separate material gate housings 26, 28, 30 and the sealing valve housing 32, 32', e.g. for maintenance purposes and parts exchange.

In addition to the above advantages, the disclosed three hopper charging installation 10' has the following advantages over both a two hopper charging installation and a single hopper ("central feed") charging installation:

- By virtue of the configuration of the sealing valve housing 32', the lower sealing valves (e.g. 170, 172) can be open simultaneously. Hence, two types of material can be charged simultaneously from two separate hoppers (e.g.

20, 22). Among others, this enables charging a mix of two materials having different grain size (granulometry) such as sinter and pellets. Segregation which occurs when such a mix is stored as premix in a single hopper is avoided.

A three hopper charging installation allows increased effective charging time. The operating time of the sealing valve and material gate valve can be masked because one hopper can be prepared for feeding the distribution device during the time the second hopper is being emptied and the third hopper is being filled. The burden can be positioned more accurately in the furnace, since the distribution device can be fed with charge material continuously. In fact, an increased number of chute revolutions with effective discharge can be carried out during a charging cycle of given time. Hence burden profile resolution is improved.

Small batches, e.g. centre coke batches, can be charged without causing a decrease in capacity or accuracy. Furthermore, several of such batches can be stored in the third hopper and released sequentially while the first two hoppers remain available for charging. No intermediate equalising is required.

Complex charging sequences can be achieved in shorter time, e.g. sequences with several different ferrous materials and small centre coke batches.

Lifetime of the hoppers and their material gate and sealing valves is increased compared to a two hopper installation.

A three hopper charging installation increases the total charging capacity of the charging installation.

One hopper can be out of service, e.g. during maintenance of because of a defect, without excessive reduction of the effective charging time since two hoppers will remain operational.

The invention claimed is:

1. A three hopper charging installation for a shaft furnace comprising:

a rotary distribution device for distributing bulk material in a shaft furnace by rotating a distribution member about a central axis of said shaft furnace;

a first hopper, a second hopper and a third hopper arranged in parallel above said rotary distribution device and offset from said central axis, for storing bulk material to be fed to said distribution device;

a sealing valve housing arranged between said hoppers and said distribution device; said sealing valve housing having:

a top part with a first inlet, a second inlet and a third inlet respectively communicating with said first hopper, said second hopper and said third hopper;

a first sealing valve, a second sealing valve and a third sealing valve for isolating said first hopper, said second hopper and said third hopper respectively from the inner atmosphere of said shaft furnace, each sealing valve comprising a respective flap which is pivotable between a closed sealing position and an open parking position; and a funnel shaped bottom part with an outlet communicating with said distribution device;

wherein said top part of said sealing valve housing has a tripartite stellate configuration in horizontal section with a central portion, in which said inlets are arranged adjacently in triangular relationship about said central axis, and with a first extension portion, a second extension portion and a third extension portion, wherein said first extension portion is dedicated to said first sealing valve and individually encloses said first sealing valve at three sides of said first sealing valve, said second extension portion is dedicated to said second sealing valve and individually encloses said second sealing valve at three sides of said second sealing valve, and said third extension portion is dedicated to said third sealing valve and individually encloses said third sealing valve at three sides of said third sealing valve, wherein each sealing valve is adapted such that its flap opens outwardly into the extension portion dedicated thereto with respect to said central axis by pivoting into a parking position located in said first extension portion, said second extension portion or said third extension portion respectively.

2. The charging installation according to claim 1, wherein the centre lines of said inlets are equidistant and form an equilateral triangle in horizontal section.

3. The charging installation according to claim 2, wherein said inlets have identical circular cross-section and the distance between the centre line of each inlet and said central axis is in the range between 1.15 and 2.5 times the radius of said circular cross-section.

4. The charging installation according to claim 3, wherein each extension portion of said sealing valve housing extends in the direction of one of the median lines of said equilateral triangle respectively.

5. The charging installation according to claim 1, wherein each hopper has a lower funnel part ending in an outlet portion and each hopper has a material gate valve with a shutter member associated to its outlet portion for varying a valve opening area at said associated outlet portion, each funnel part being configured asymmetrically with its outlet portion being eccentric and arranged proximate to said central axis, each outlet portion being oriented vertically above a respective inlet of said sealing valve housing so as to produce a substantially vertical outflow of bulk material into said sealing valve housing and each material gate valve being configured with its shutter member opening in a direction pointing away from said central axis such that any partial valve opening area is located on the side of said associated outlet portion proximate to said central axis.

6. The charging installation according to claim 5, wherein each funnel part is configured according to the surface of a frustum of an oblique circular cone.

7. The charging installation according to claim 1, wherein each extension portion has a height exceeding the diameter of said flap.

8. The charging installation according to claim 7, wherein each sealing valve is configured with a pivoting angle of its flap of at least 90°.

9. The charging installation according to claim 1, further comprising a first, a second and a third independent material gate housing detachably connected upstream of said first, said second and said third inlet respectively.

10. The charging installation according to claim 1, wherein each of said extension portions includes an access door configured to allow access to each of said sealing valves to which each of said extension portions is dedicated.

11. A three hopper charging installation for a shaft furnace comprising:

a rotary distribution device for distributing bulk material in a shaft furnace by rotating a distribution member about a central axis of said shaft furnace;

a first hopper, a second hopper and a third hopper arranged in parallel above said rotary distribution device and offset from said central axis, for storing bulk material to be fed to said distribution device;

a sealing valve housing arranged between said hoppers and said distribution device; said sealing valve housing having:

a first sealing valve, a second sealing valve and a third sealing valve for isolating said first hopper, said second hopper and said third hopper respectively from the inner atmosphere of said shaft furnace, each sealing valve comprising a respective flap which is pivotable between a closed sealing position and an open parking position;

a top part with a first inlet, a second inlet and a third inlet respectively communicating with said first hopper, said second hopper and said third hopper, said top part of said sealing valve housing having a star-shaped configuration with three parts formed by a first extension portion, a second extension portion and a third extension portion, wherein said first extension portion is dedicated to said first sealing valve and individually encloses said first sealing valve at three sides of said first sealing valve said second extension portion is dedicated to said second sealing valve and individually encloses said second sealing valve at three sides of said second sealing valve, and said third extension portion is dedicated to said third sealing valve and individually encloses said third sealing valve at three sides of said third sealing valve, wherein each sealing valve is adapted such that its flap opens outwardly into the extension portion dedicated thereto away from said central axis by pivoting into a parking position located in said first extension portion, said second extension portion or said third extension portion respectively; and a funnel shaped bottom part with an outlet communicating with said distribution device;

a first material gate housing, a second material gate housing and a third material gate housing, said material gate housings being independent and detachably connected upstream of said first inlet, said second inlet and said third inlet of said sealing valve housing respectively.

12. The charging installation according to claim 11, wherein the centre lines of said inlets are equidistant and form an equilateral triangle in horizontal section.

13. The charging installation according to claim 12, wherein said inlets have identical circular cross-section and the distance between the centre line of each inlet and said central axis is in the range between 1.15 and 2.5 times the radius of said circular cross-section.

14. The charging installation according to claim 13, wherein each extension portion of said sealing valve housing extends in the direction of one of the median lines of said equilateral triangle respectively.

15. The charging installation according to claim 11, wherein each hopper has a lower funnel part ending in an outlet portion and each hopper has a material gate valve with a shutter member associated to its outlet portion for varying a valve opening area at said associated outlet portion, each funnel part being configured asymmetrically with its outlet portion being eccentric and arranged proximate to said central axis, each outlet portion being oriented vertically above a respective inlet of said sealing valve housing so as to produce a substantially vertical outflow of bulk material into said sealing valve housing and each material gate valve being configured with its shutter member opening in a direction pointing away from said central axis such that any partial valve opening area is located on the side of said associated outlet portion proximate to said central axis.

16. The charging installation according to claim 15, wherein each funnel part is configured according to the surface of a frustum of an oblique circular cone.

17. The charging installation according to claim 16, wherein each extension portion has a height exceeding the diameter of said flap and each sealing valve is configured with a pivoting angle of its flap of at least 90°.

18. A blast furnace equipped with a three hopper charging installation, said installation comprising:

a rotary distribution device for distributing bulk material in said blast furnace by rotating a distribution member about a central axis of said blast furnace;

a first hopper, a second hopper and a third hopper arranged above said rotary distribution device and offset from said central axis, for storing bulk material to be fed to said distribution device;

a sealing valve housing arranged between said hoppers and said distribution device; said sealing valve housing having:

a first sealing valve, a second sealing valve and a third sealing valve for isolating said first hopper, said second hopper and said third hopper respectively from the inner atmosphere of said shaft furnace, each sealing valve comprising a respective flap which is arranged inside said sealing valve housing so as to be pivotable between a closed sealing position and an open parking position;

a top part with a first inlet, a second inlet and a third inlet respectively communicating with said first hopper, said second hopper and said third hopper; said top part of said sealing valve housing having a tripartite configuration with a first extension portion, a second extension portion and a third extension portion, wherein said first extension portion is dedicated to said first sealing valve and individually encloses said first sealing valve at three sides of said first sealing valve, said second extension portion is dedicated to said second sealing valve and individually encloses said second sealing valve at three sides of said second sealing valve, and said third extension portion is dedicated to said third sealing valve and individually encloses said third sealing valve at three sides of said third sealing valve, wherein each extension portion is configured to receive a respective sealing valve flap therein and each sealing valve is adapted such that its flap opens outwardly into the extension portion dedicated thereto away from said central axis by pivoting into a parking position located in said first extension portion, said second extension portion or said third extension portion respectively; and a funnel shaped bottom part with an outlet communicating with said distribution device.

19. The blast furnace according to claim 18, wherein the centre lines of said inlets are equidistant and form an equilateral triangle in horizontal section.

20. The blast furnace according to claim 19, wherein each extension portion of said sealing valve housing extends in the direction of one of the median lines of said equilateral triangle respectively.

21. The blast furnace according to claim 18, wherein said inlets have identical circular cross-section and the distance between the centre line of each inlet and said central axis is in the range between 1.15 and 2.5 times the radius of said circular cross-section.

22. The blast furnace according to claim 18, wherein each hopper has a lower funnel part ending in an outlet portion and each hopper has a material gate valve with a shutter member associated to its outlet portion for varying a valve opening area at said associated outlet portion, each funnel part being configured asymmetrically with its outlet portion being eccentric and arranged proximate to said central axis, each outlet portion being oriented vertically above a respective inlet of said sealing valve housing so as to produce a substantially vertical outflow of bulk material into said sealing valve housing and each material gate valve being configured with its shutter member opening in a direction pointing away from said central axis such that any partial valve opening area is located on the side of said associated outlet portion proximate to said central axis.

23. The blast furnace according to claim 22, wherein each funnel part is configured according to the surface of a frustum of an oblique circular cone.

24. The blast furnace according to claim 18, wherein each extension portion has a height exceeding the diameter of said flap.

25. The blast furnace according to claim 18, wherein each sealing valve is configured with a pivoting angle of its flap of at least 90° about a horizontal pivoting axis.

26. The blast furnace according to claim 18, further comprising a first, a second and a third material gate housing arranged independently above said sealing valve housing and connected upstream of said first, said second and said third inlet of said sealing valve housing respectively.

* * * * *